US011670890B2

(12) United States Patent
Genta et al.

(10) Patent No.: US 11,670,890 B2
(45) Date of Patent: Jun. 6, 2023

(54) HOUSING PART FOR AN ELECTRICAL CONNECTOR WITH IMPROVED SEALING AND HOUSING ASSEMBLY

(71) Applicants: TE Connectivity Germany GmbH, Bensheim (DE); TE Connectivity Italia Distribution S.r.l., Turin (IT)

(72) Inventors: Alessandro Genta, Turin (IT); Raoul Zannini, Turin (IT); Dominik Heiss, Bensheim (DE); Simon Beau, Bensheim (DE)

(73) Assignees: TE Connectivity Germany GmbH, Bensheim (DE); TE Connectivity Italia Distribution S.R.L., Turin (IT)

( * ) Notice: Subject to any disclaimer, the term of this patent is extended or adjusted under 35 U.S.C. 154(b) by 58 days.

(21) Appl. No.: 17/308,276

(22) Filed: May 5, 2021

(65) Prior Publication Data

US 2021/0351543 A1 Nov. 11, 2021

(30) Foreign Application Priority Data

May 5, 2020 (IT) ..... 102020000009811

(51) Int. Cl.
*H01R 13/46* (2006.01)
*H01R 13/52* (2006.01)
*H01R 13/512* (2006.01)

(52) U.S. Cl.
CPC ..... *H01R 13/5208* (2013.01); *H01R 13/512* (2013.01); *H01R 13/5202* (2013.01); *H01R 2201/26* (2013.01)

(58) Field of Classification Search
CPC ..... H01R 13/5208; H01R 13/512; H01R 13/5202; H01R 2201/26
USPC ..... 439/892
See application file for complete search history.

(56) References Cited

U.S. PATENT DOCUMENTS

| | | | | |
|---|---|---|---|---|
| 3,576,937 | A | 5/1971 | Eldridge, Jr. | |
| 3,992,569 | A * | 11/1976 | Hankins | H02G 15/003 174/76 |
| 4,914,261 | A | 4/1990 | Tokumaru et al. | |
| 5,675,124 | A | 10/1997 | Stough et al. | |
| 6,116,931 | A * | 9/2000 | McCleerey | H01R 4/06 439/651 |

(Continued)

FOREIGN PATENT DOCUMENTS

| | | | |
|---|---|---|---|
| EP | 0514174 | A1 | 11/1992 |
| FR | 2723162 | A1 | 2/1996 |
| WO | 2011162926 | A2 | 12/2011 |

OTHER PUBLICATIONS

Extended European Search Report dated Sep. 9, 2021 in Appln. No. 21172294.7, 8 pp.

(Continued)

*Primary Examiner* — Abdullah A Riyami
*Assistant Examiner* — Vladimir Imas
(74) *Attorney, Agent, or Firm* — Barley Snyder

(57) ABSTRACT

A housing part for an electrical connector includes a cable channel receiving a cable, a flange surface adapted to abut a complementary housing part, and a sealing gasket extending along the flange surface. The sealing gasket has a pair of cable sealing portions extending across the cable channel. The cable sealing portions are spaced apart from one another in an axial direction of the cable channel.

17 Claims, 7 Drawing Sheets

(56) References Cited

U.S. PATENT DOCUMENTS

| | | | | |
|---|---|---|---|---|
| 6,881,901 | B2 * | 4/2005 | Egan | H02G 15/013 174/665 |
| 7,699,653 | B2 * | 4/2010 | Sakamoto | H01R 13/5221 174/92 |
| 9,012,774 | B2 * | 4/2015 | Simmons | H01R 9/223 174/93 |
| 10,056,718 | B2 * | 8/2018 | Dang | H01R 13/6589 |
| 11,177,585 | B2 * | 11/2021 | Arflack | H01R 4/2407 |
| 2022/0029347 | A1 * | 1/2022 | Genta | H01R 13/5025 |

OTHER PUBLICATIONS

Italian Search Report and Written Opinion, dated Oct. 21, 2020, 7 pages.
Abstract of FR 2723162(A1), dated Feb. 2, 1996, 1 page.

* cited by examiner

HOUSING PART FOR AN ELECTRICAL CONNECTOR WITH IMPROVED SEALING AND HOUSING ASSEMBLY

CROSS-REFERENCE TO RELATED APPLICATION

This application claims the benefit of the filing date under 35 U.S.C. § 119(a)-(d) of Italian Patent Application No. 102020000009811, filed on May 5, 2020.

FIELD OF THE INVENTION

The present invention relates to an electrical connector and, more particularly, to a housing part for an electrical connector.

BACKGROUND

In prior art solutions, in particular in automotive applications, it is required to integrate a plurality of cables with different sizes in a connector. In the connector, contact elements contact the wires, and an inside of the connector needs to be sealed against an outside. Some solutions use, for instance, a different grommet seal for each different combination of wires. For power contacts associated with larger cables, the cable is in general inserted through a corresponding hole in the grommet seal and is subsequently crimped onto the wire. This makes the complete assembly process expensive, complex, and time-consuming.

SUMMARY

A housing part for an electrical connector includes a cable channel receiving a cable, a flange surface adapted to abut a complementary housing part, and a sealing gasket extending along the flange surface. The sealing gasket has a pair of cable sealing portions extending across the cable channel. The cable sealing portions are spaced apart from one another in an axial direction of the cable channel.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
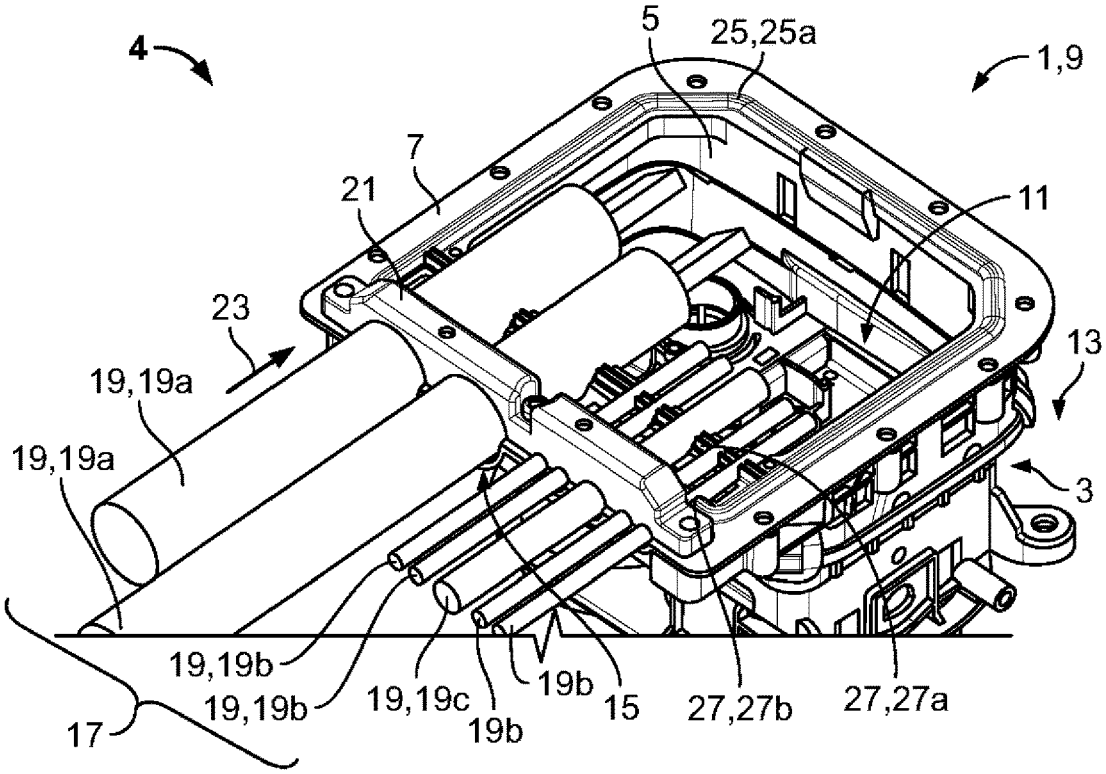
FIG. 1 is a perspective view of a housing part according to an embodiment.

In the following, the present invention will be described by way of example with reference to the accompanying figures. The figures show exemplary embodiments of the housing part, the complementary housing part and the housing assembly, wherein those embodiments represent an arbitrary combination of technical features. Different arbitrary combinations of technical features are conceivable and features may also be omitted, if the technical effect obtained by the omitted technical features is not relevant to the present invention.

In the figures, same features or features having the same function are denoted with the same reference numeral. A repetition of descriptions is avoided, wherein differences between the different examples are explicitly given.

FIG. 1 shows a housing part 1 according to an embodiment which is attached to a connecting structure 3. The connecting structure 3 may be a part of an electrical connector 4. The housing part 1 comprises a housing shell 5 and a flange surface 7. The housing part 1 is shown in an unjoined state 9, in which it is not attached to a complementary housing part, which will be described subsequently.

In the unjoined state 9, access to an interior 11 of the housing part 1 is possible. An outside of the housing part 1 is denoted with reference numeral 13. The outside 13 denotes the space around the housing part 1.

Figure 2:
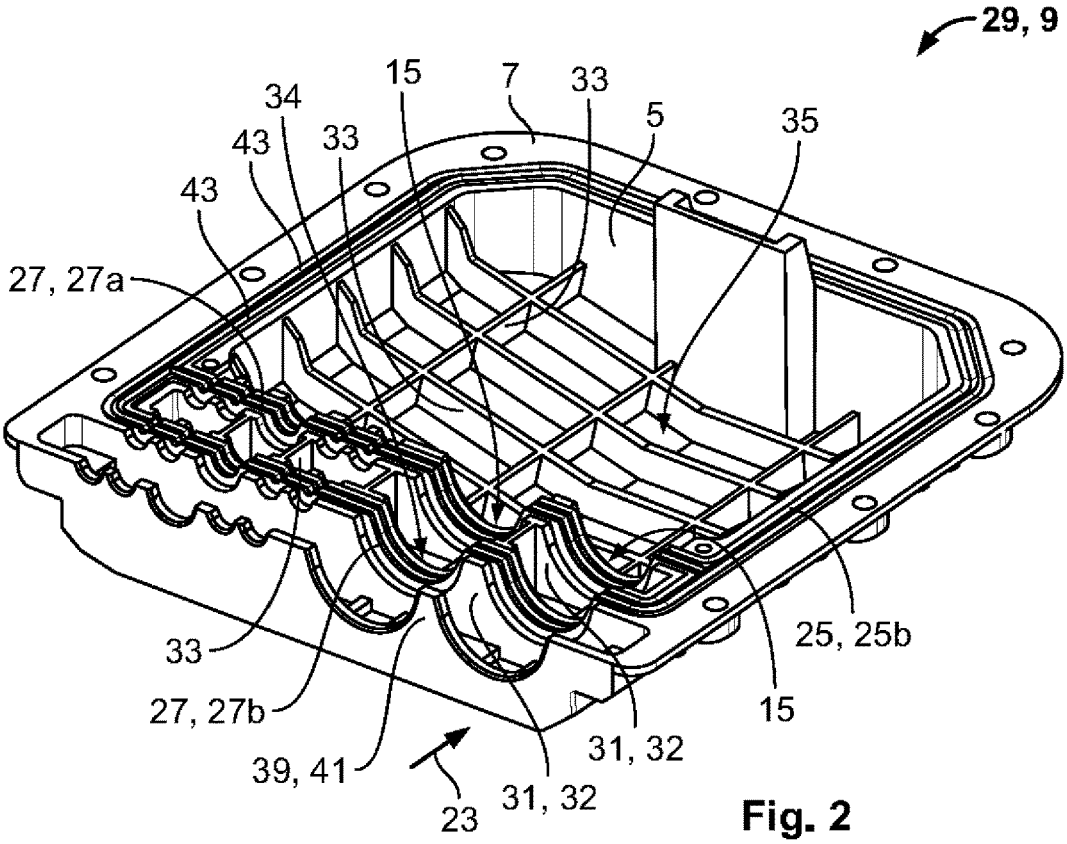
FIG. 2 is a perspective view of a complementary housing part according to an embodiment.

The embodiment of the housing part 1 shown in FIG. 1 has seven cable channels 15, wherein only one cable channel 15 is indicated (the cable channels 15 are better seen in FIG. 2). In each of the cable channels 15, a cable 17 is received. The multitude of cables 17 is indicated with a bracket. Several of the cables 17 shown have different diameters 19*a*, 19*b* or 19*c*. In different embodiments, the housing part 1 may be adapted to receive cables of the same diameter 19 or each cable 17 may have a different diameter 19. The exemplary shown cables 17 are received in the corresponding cable channel 15 and are fixed to the housing shell 5 by a strain relief member 21, which prevents a displacement of the cables 17 along an axial direction 23 and perpendicular thereto.

The housing part 1 further comprises a sealing gasket 25 as shown in FIG. 1, which extends along the flange surface 7. The sealing gasket 25 may be overmolded by the material of the housing part 1 and may thus extend in the flange section 7. In the embodiment shown, the sealing gasket 25 extends continuously and uninterruptedly along the surface of the flange section 7. By such an overmolding (or dispensing), the interface between the sealing gasket 25 and a shell of the housing part 1 is impermeable and protected against water or air ingress. The sealing gasket 25 may comprise, as seen in the cross section, a holding structure forming a positive lock with the housing part 1, which engages behind such a holding structure. The holding structure may be formed as a bend section in the shape of an "L" or in the shape of a "T", which shape is turned around. In an embodiment, the sealing gasket 25 may have a double-rib sealing surface. The gasket 25 may have any structure extending from the flange surface 7, i.e. triangular or half-circular, wherein this structure may be provided two three or even more times in the axial direction. The extending structure may have the shape of a triangle, a half circle or the like.

Further embodiments are conceivable, in which the sealing gasket 25 is interrupted, wherein sealing may be provided differently in the interrupted portion, e.g. by a film hinge or the like. The sealing gasket 25 may be configured as a longitudinal elongated strip, which may continuously surround a perimeter of the housing part 1. In an embodiment, the sealing gasket 25 is embedded in a wall 18, which at least partially surrounds the cable channel 15. In an embodiment, the sealing gasket 25, at least in portions, is embedded in the flange surface 7. The sealing gasket 25 may be overmolded by the material of the housing part 1 and may therefore partially extend in the flange surface 7. The sealing gasket then may protrude from the flange surface 7.

The flange surface 7 may be, at least in portions, planar, but may as well have a structure. In any case, the flange surface 7 is adapted for abutment to the complementary housing part 29, which the complementary shape or structure of the corresponding complementary flange surface 7.

The sealing gasket 25 comprises, in the embodiment shown in FIG. 1, two cable sealing portions 27 that extend across the cable channels 15 (reference is made to FIG. 2) and follow a shape of the cable channels 15. The cable channel 15 may have a shape of a shell of a half cylinder, i.e. the cross section of the cable channel 15 may correspond to a half circle shaped inner surface. The sealing portions 27 may also have such a half circle shaped progression across the cable channel 15, in particular along the wall of the cable channel 15. This wall may be addressed as cable channel wall. As can be seen, one cable sealing portion 27*a* is spaced apart from another cable sealing portion 27*b* in the axial direction 23. The cable sealing portions 27 shown in the present embodiments are parallel to one another.

The at least one cable channel 15 may extend in a radial direction, which may, at least in portions, be oriented perpendicular to the sealing gasket 25. The at least one cable channel 15 may in particular connect an exterior of the housing part 1 with an interior of the housing part 1.

FIG. 2 shows a complementary housing part 29, which is also shown in the unjoined state 9. The housing part 1 and the complementary housing part 29 do have several features in common, namely the flange surface 7, the shell 5 and the sealing gasket 25. To differentiate the sealing gasket 25 of the housing part 1 and the sealing gasket 25 of the complementary housing part 29, the former is referred to with reference numeral 25*a* and the latter with reference numeral 25*b*. Also the complementary housing part 29 has cable channels 15; two of them are indicated in FIG. 2.

In FIG. 2, the structure of the cable channels 15 is visible. The housing part 1 of FIG. 1 may comprise cable channels 15 configured identically or similar. In the embodiment shown, the cable channels 15 are formed by two protruding ribs 31, which are spaced apart from one another in the axial direction 23. The protruding ribs 31 are connected with each other by a supporting web 33. The protruding ribs 31 may be considered as bulkheads 32, wherein the bulkheads 32 as well as the supporting web 33 extend from a bottom 34 of the corresponding cable channel 15. Further supporting webs 33 are shown in a cover 35 of the complementary housing part 29. Those supporting webs 33 stabilize the complementary housing part 29 and allow for a reduction of the material necessary for production of such. The bulkheads 32 may stabilize the housing assembly 45 and may reduce the material necessary to achieve such a stability. The bulkheads 32 may in particular reach into the cable opening 16 formed by the opposing cable channels 15.

Figure 10:
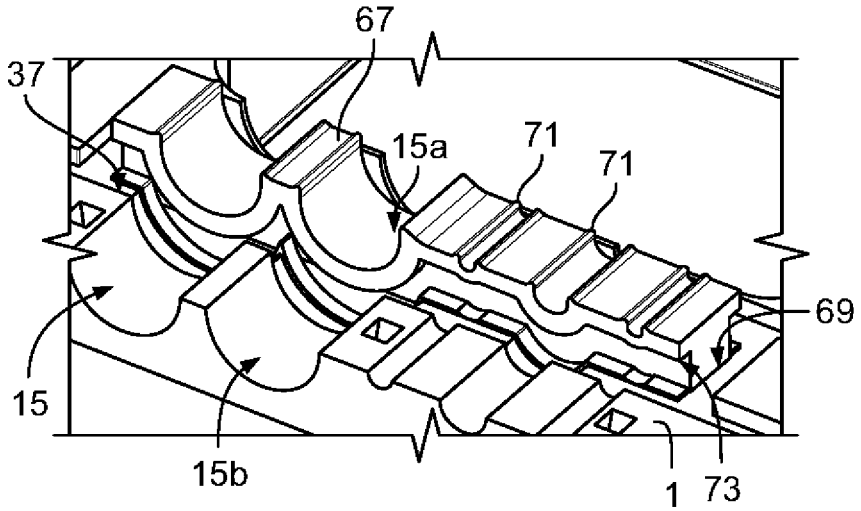
FIG. 10 is a detail perspective view of a housing part according to another embodiment including a grommet part.

The sealing gasket 25*b* also has two cable sealing portions 27*a* and 27*b*. In FIG. 2 it may be seen that both cable sealing portions 27 extend across the cable channels 15, wherein the cable channels 15 are formed by the two protruding ribs 31. FIG. 10 shows a gasket notch 37, in which the sealing gasket 25, and in particular the cable sealing portions 27 may be inserted as an alternative to overmolding. The gasket notch 37 may also be referred to as groove 37 (see FIG. 10).

In the embodiment shown in FIG. 2, the cable sealing portions 27 are provided at the protruding ribs 31 and an additional supporting rib 39 is provided, which is spaced apart opposite to the axial direction 23 from the protruding ribs 31. The supporting rib 39 may have the same shape and/or size as the protruding ribs 31. This supporting rib 39 is adapted for supporting a cable 17 received in the cable channel 15. In the embodiment shown, the supporting rib 39 forms an outer wall 41 of the complementary housing part 29. The housing part 1 of FIG. 1 may also comprise such a supporting rib 39 that forms the outer wall 41 of the housing part 1. Such a supporting rib 39 prevents the cables 17 from bending in the cable channels 15. Without bending of the cable 17 in the area of the cable channel 15, each of the cable sealing portions 27 may be pressed against the cable 17 with a same pressure, which may not be the case if the cable 17 would be bent at or between the protruding ribs 31.

Further, as shown in FIG. 2, the sealing gasket 25 comprises gasket ribs 43, which will be seen in more detail in the following. The gasket ribs 43 extend continuously and uninterruptedly along the surface of the flange section 7 and across the cable channels 15.

The strain relief member 21 shown in FIG. 1 will, when the housing part 1 and the complementary housing part 29 are joined to one another, be received between the outermost protruding rib 31 and the supporting rib 39.

Figure 3:
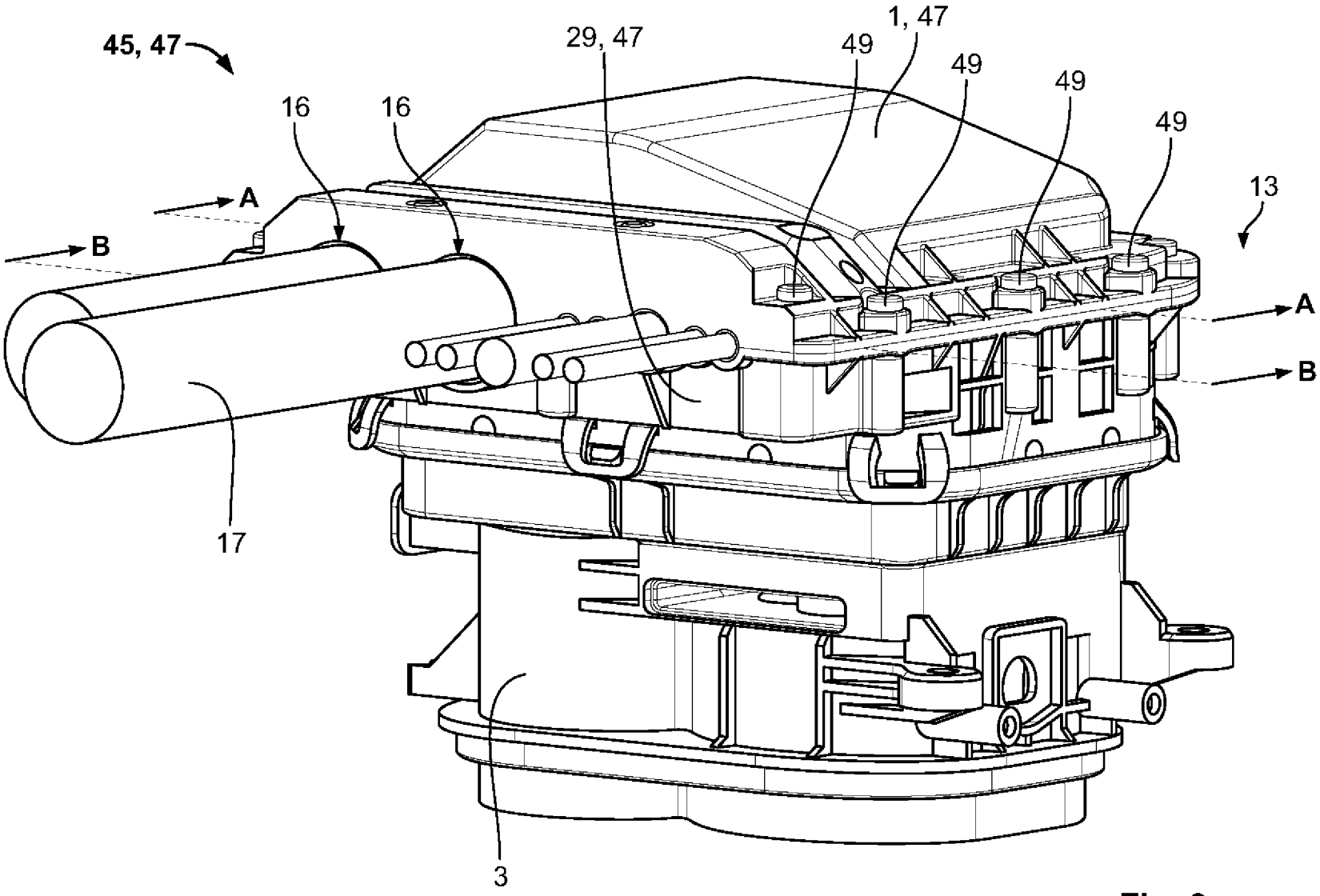
FIG. 3 is a perspective view of a housing assembly according to an embodiment in a joined state.

FIG. 3 shows a housing assembly 45 according to an embodiment in a joined state 47, in which the housing part 1 and the complementary housing part 29 are joined to one another. In addition, the housing part 1 and the complementary housing part 29 are in the joined state 47.

In the joined state 47, the cable channels 15 of the housing part 1 and the complementary housing part 29 form cable openings 16. When the cables 17 are received in the corresponding cable openings 16 formed by the corresponding cable channels 15, the interior 11 (see FIG. 1) is sealed against the outside 15. The housing part 1 and the complementary housing part 29 are held at each other, in particular are pressed against each other by fixation devices 49, e.g. screws, rivets, bolts or a combination of those. By this pressure, the flange section 7 of the housing part 1 is pressed against the flange section 7 of the complementary housing part 29.

Figure 4:
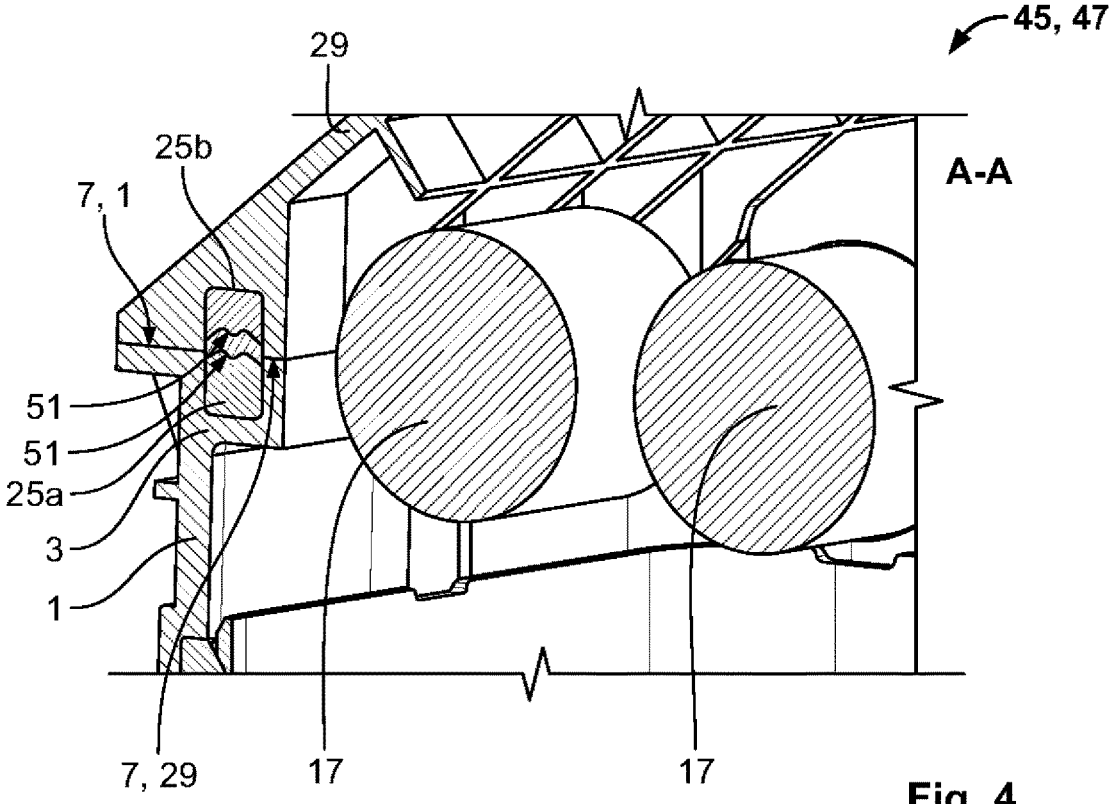
FIG. 4 is a detail sectional perspective view taken along line A-A of FIG. 3.

As shown in FIG. 4 (showing a cut view along the line A-A), the sealing gasket 25*a* of the housing part 1 slightly distinguishes from the sealing gasket 25*b* of the complementary housing part 29. They may be distinguished by the position of their gasket ribs 43. The gasket ribs 43 of the sealing gaskets 25*a* and 25*b* are arranged offset from one another along or opposite a direction directed from the interior 11 to the outside 13, such that a contour 51 of the sealing gasket 25*a* is complementary to a contour 51 of the sealing gasket 25*b*, at least in the unjoined state 9. When the housing part 1 and the complementary housing part 29 are pressed against each other any contour 51 of the sealing gasket 25 would be deformed such that the contour 51 of the two sealing gaskets 25 would be complementarity one to another.

Figure 5:
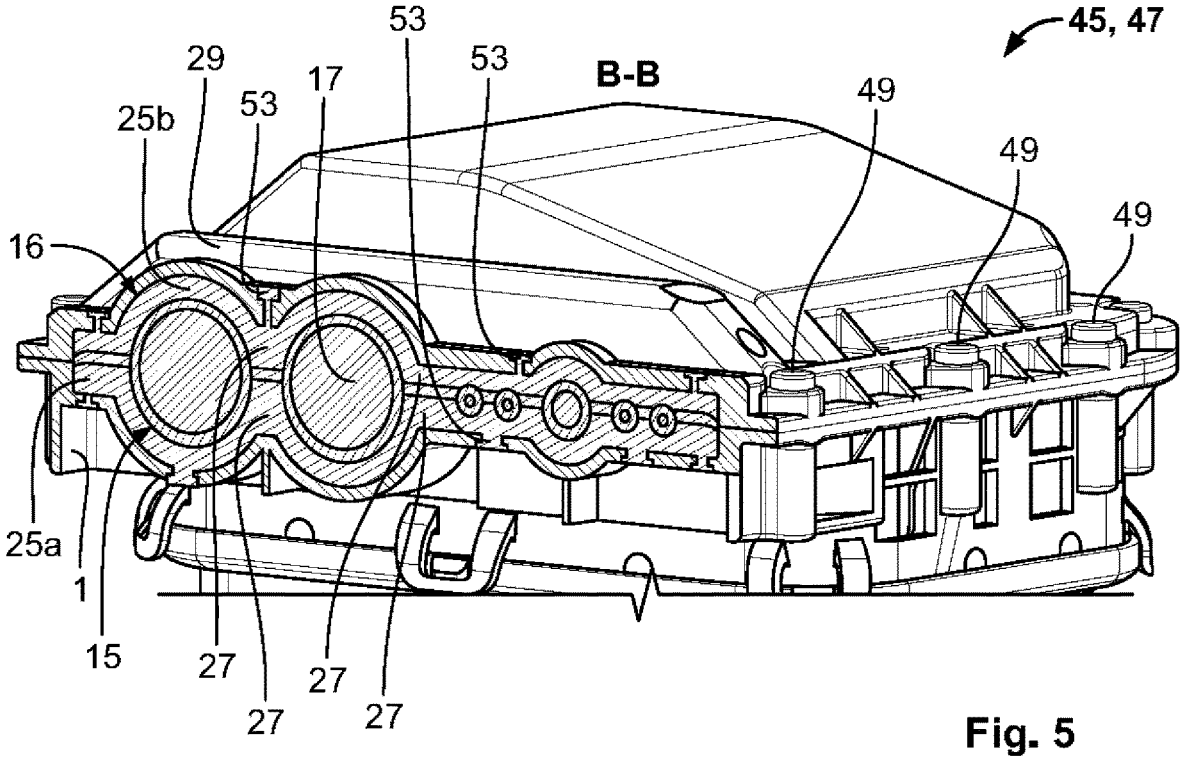
FIG. 5 is a sectional perspective view taken along line B-B of FIG. 3.

FIG. 5 shows the cut view along the line B-B of FIG. 3 at a position of a cable sealing portion 27. Also in the cable channels 15, the gasket ribs 43 are offset from one another and therefore in mesh, which increases an effective abutment area between sealing gasket 25*a* and sealing gasket 25*b*, resulting in an improved sealing property. It can be seen that the two cable sealing portions 25*a* and 25*b* do not leave any open space between each other or between the corresponding cable sealing portion 27 and the cable 17. Further, overmold anchor structures 53 are shown, which are provided in both the sealing gasket 25*a* of the housing part 1 as well in the sealing gasket 25*b* of the complementary housing part 29. Those overmold (or dispensed) anchor structures 53 reliably fix the gaskets 25 in the corresponding housing part 1 or 29.

The housing assembly 45 may be further improved by providing a cable retainer between one of the two protruding ribs 31 forming the cable channel wall 18 of both the housing part 1 and the complementary housing part 29 and an outer wall 41 of the housing assembly 45. The cable retainer may be also applied as strain relief, which secures the cable 17 against movement or displacement in the axial direction and in the direction perpendicular to the axial direction.

As at least two cable sealing portions 27 are provided, the housing part 1 is adapted to abut, and in an embodiment be pressed against, the cable 17 received in the cable channel 15 at two different positions spaced apart from another in the axial direction, therefore providing a sealing redundancy.

By providing the housing part 1, the sealing system is completely independent of an assembly of the wire or cables. Thus, the cable 17 or wire may be electrically connected to a further connection device, e.g. cable shoes and the like, and subsequently be inserted into the housing part 1, which overcomes the drawbacks of inserting a cable 17 or wire through a grommet and subsequently connect the wire 17 to further connection means inside the connector with reduced installation space. The inventive housing part 1 thus makes assembly of an electrical connector less complex, faster and reduces costs. The wiring assembly process may be thus highly simplified, as it becomes independent from contact design and wire typology, whilst assuring a high level sealing performance. The inventive housing part 1 and housing assembly 45 may in particular comply with international sealing standards.

The housing part 1 and the housing assembly 45 may in particular be used for a cable exit of an inlet housing, which provides an input or output port at which at least one cable 17 is received, wherein the cable exit is reliably sealed against ambient influences like water.

The following FIGS. 6, 7, 8 and 9 show a further embodiment of the inventive housing part 1, of the inventive complementary housing part 29 and cut views of the inventive housing assembly 45, respectively.

Figure 6:
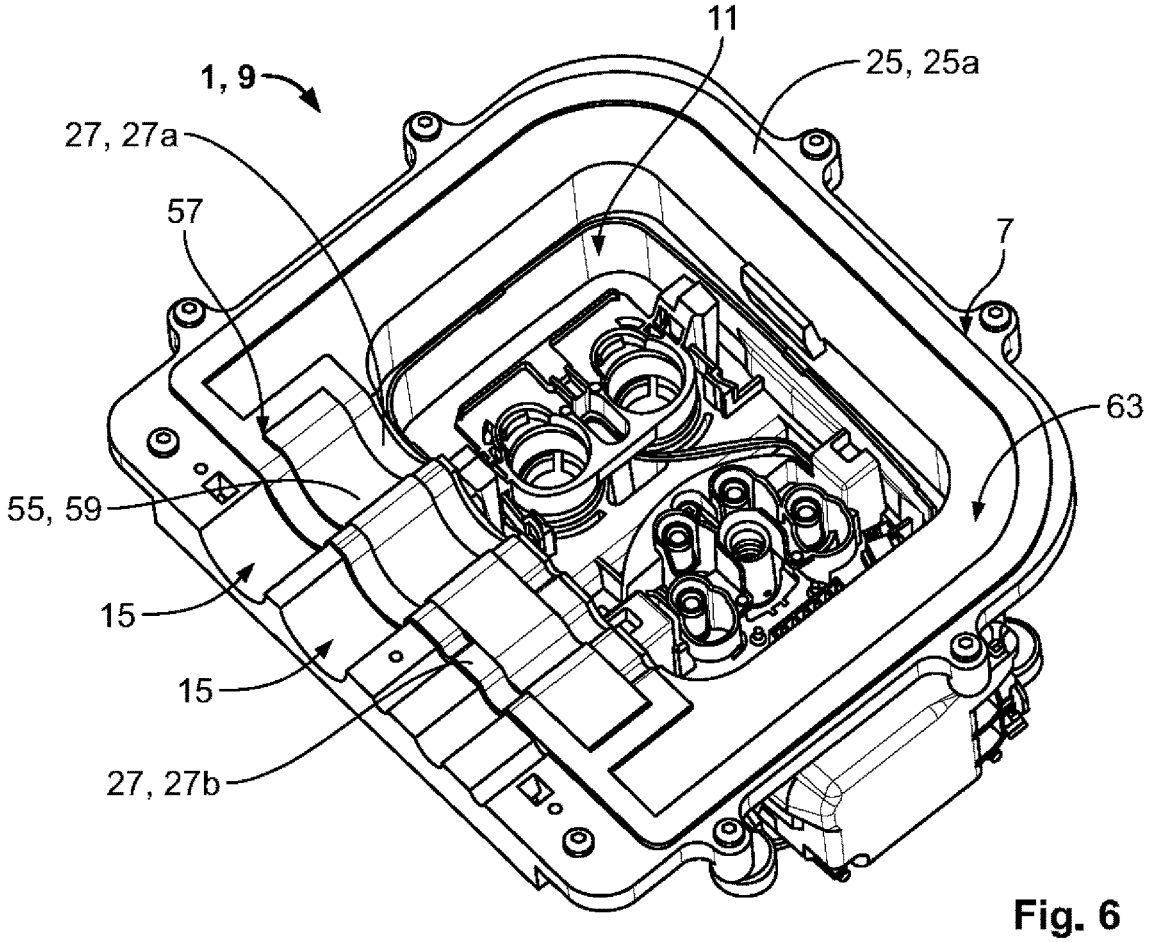
FIG. 6 is a perspective view of a housing part according to another embodiment.
Figure 7:
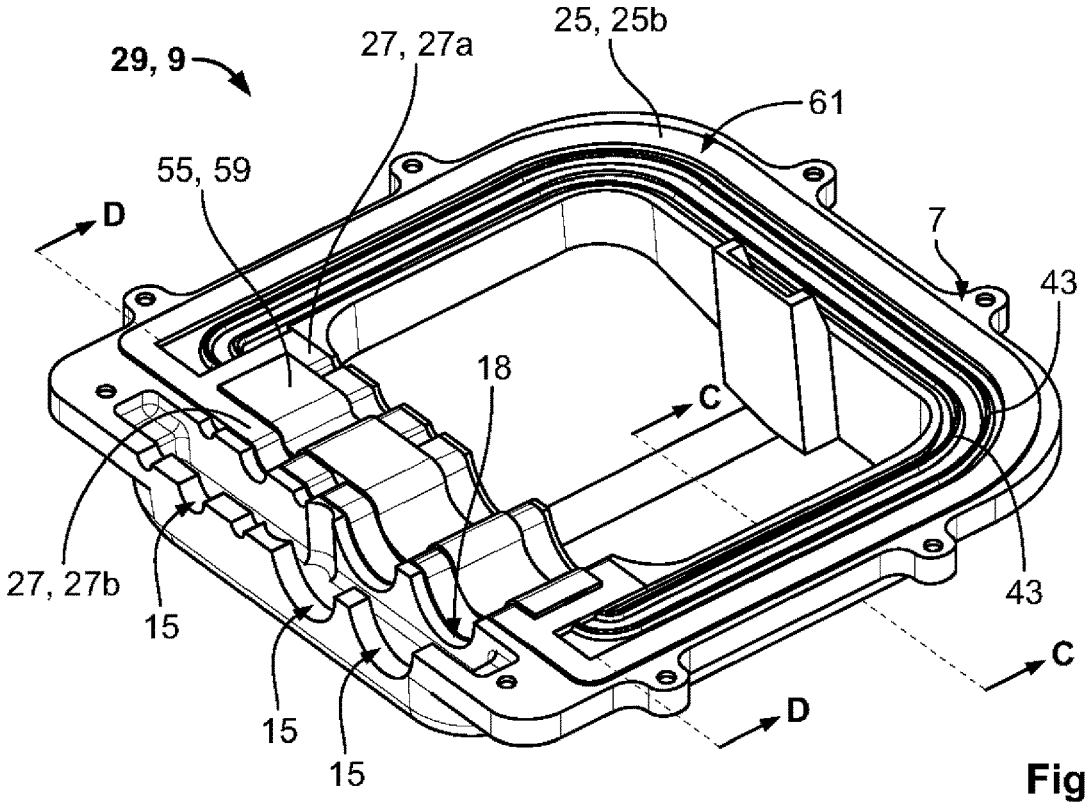
FIG. 7 is a perspective view of a complementary housing part according to another embodiment.
Figure 9:
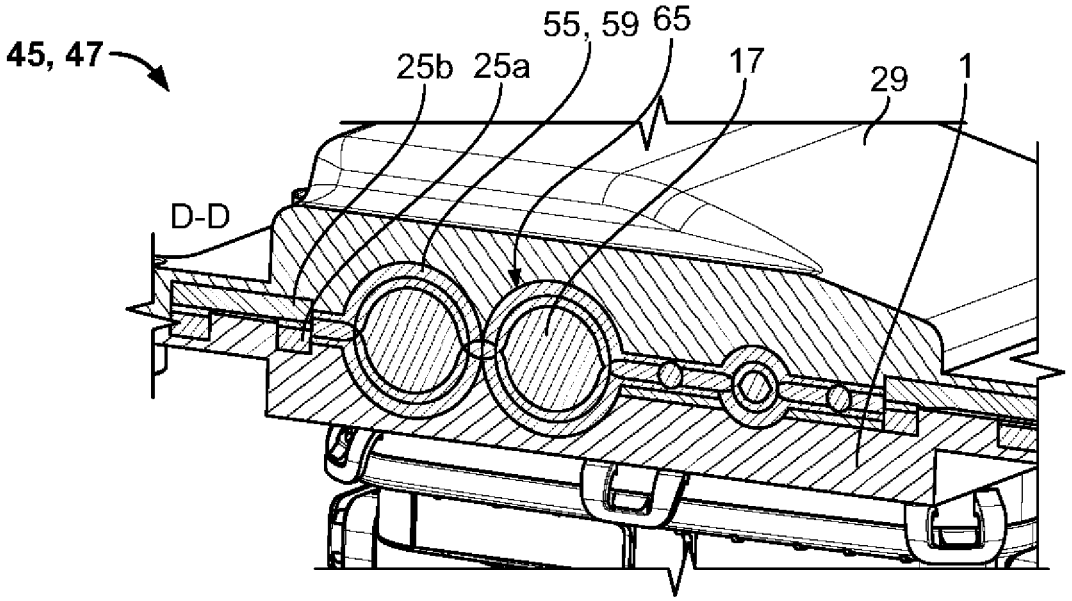
FIG. 9 is a detail sectional perspective view of the housing assembly including the housing part of FIG. 6 and the complementary housing part of FIG. 7 taken along line D-D of FIG. 7.

One main difference between the previously described embodiments of the inventive housing part 1, the inventive complementary housing part 29, and the inventive housing assembly 45 is a separate sealing material 55 provided in a sealing depression 57, which is provided between the cable sealing portions 27*a* and 27*b*, as shown in FIGS. 6, 7, and 9. Further, the structure of the sealing gaskets 25*a* and 25*b* also distinguishes from those sealing gaskets 25 of the previously described embodiment. The separate sealing material 55 may in particular be a gel 59, which has a very high flexibility and is suitable to compensate for tolerances larger than tolerances a silicon member are suitable to compensate for. Alternatively, the separate sealing material 55 may comprise a foam received in the sealing depression 57.

The separate sealing material 55 is flexible and also compressible in an embodiment, which allows the separate sealing material 55 to be deformed upon an applied pressure, which has the advantage that tolerances of the cable 17 and/or tolerances of the cable channel 15, e.g. in the form of protruding structures or depressed structures, may be easily compensated for. The separate sealing material 55 may in particular be flexible enough to be compressed into open voids, which may be formed between the cable channel 15 and the cable 17 received therein. The separate sealing material 55 may in particular be reusable and thus allow repeatedly engaging and disengaging a sealing connection between the separate sealing material 55 and a cable 17. The sealing gasket 25 and/or the separate sealing material 55 may be made of flexible silicone.

The separate sealing material 55 may be provided in both the housing part 1 and the complementary housing part 29 between the corresponding cable sealing portions 27*a* and 27*b*.

In the embodiment of the housing part 1 shown in FIG. 6, no gasket ribs 43 are provided and the sealing gasket 25*a* has a flat continuous and uninterrupted surface extending on the flange surface 7 and across the cable channels 15.

The embodiment of the complementary housing part 29 shown in FIG. 7 does comprise gasket ribs 43, whereas those gasket ribs 43 are not extending continuously along the flange surface 7, but are interrupted at the cable channels 15. Each cable channel 15 comprises a cable channel wall 18, along which the two cable sealing portions 27 as well as the separate sealing material 55 extend.

Figure 8:
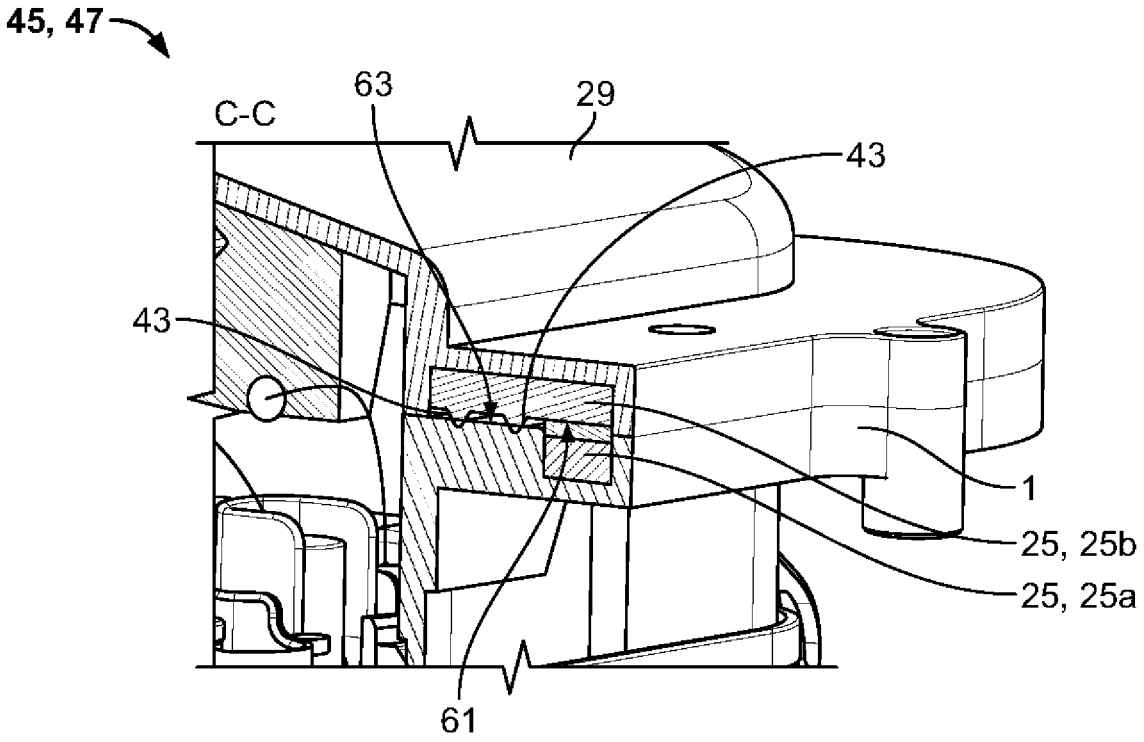
FIG. 8 is a detail sectional perspective view of a housing assembly including the housing part of FIG. 6 and the complementary housing part of FIG. 7 taken along line C-C of FIG. 7.

In this embodiment of the housing part 1 and the complementary housing part 29, if the housing part 1 and the complementary housing part 29 are joined to one another, an outer sealing gasket portion 61 of the complementary housing part 29 is pressed against the sealing gasket 25*a* of the housing part 1. At the same time, the gasket ribs 43 of the complementary housing part 29 are pressed against an inner flange surface section 63 of the housing part 1. There is no offset arrangement of structures of the different sealing gaskets 25*a* and 25*b*. This situation is shown in FIG. 8, which shows a detailed cut view along a line C-C of FIG. 7 of the housing assembly 45 in the joined state 47. Further, it can be seen how the sealing gasket 25*a* and 25*b* are overmolded in the housing part 1 or in the complementary housing part 29.

FIG. 9 shows a cut view along the line D-D of FIG. 7, showing that the housing assembly 45, comprising the housing part 1 with the separate sealing material 55 and the complementary housing part 29 with the separate sealing material 55, form an encapsulated volume. When the cables 17 are received and when the housing assembly 45 is brought into the joined state 49, the separate sealing material 55 is confined in this encapsulated volume, i.e. in a sealing material volume 65. This sealing material volume 65 is formed by, respectively formed between the sealing gaskets 25*a*, 25*b*, the cable sealing portions 27*a* and 27*b* of both, the housing part 1 and the complementary housing part 29, the cable channels 15, and the cables 17. Due to the flexibility and compressibility of the separate sealing material 55, e.g. the gel 59, the separate sealing material 55 may be pressed into any void at the cables 17.

Figure 11:
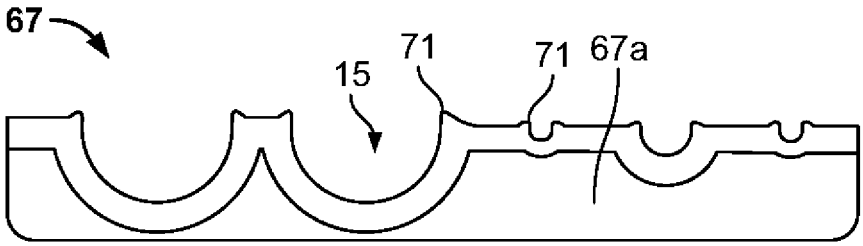
FIG. 11 is a side view of the grommet part of FIG. 10.
Figure 12:
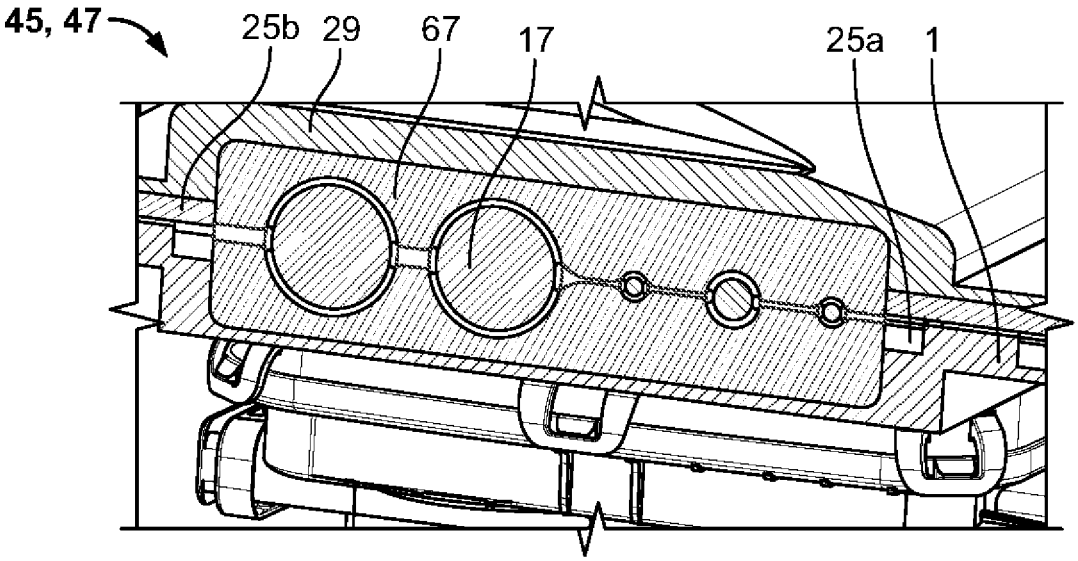
FIG. 12 is a detail sectional perspective view of a housing assembly including the grommet.

FIGS. 10, 11 and 12 show a grommet part 67, which may be placed between the cable sealing portions 27 as an alternative to the separate sealing material 55 in the form of a gel 59 or a foam. The grommet part 67 may comprise or be made of silicone 67*a*. A grommet is also known as cable grommet and as a tube or ring through which an electrical cable may pass, in order to seal the cable received. The grommet of FIG. 12 is actually a grommet member formed by two opposing grommet parts 67 for receiving the cable 17.

The grommet part 67 is received in a grommet depression 69, as shown in FIG. 10, which is formed in the housing part 1. The grommet part 67 may provide an insertion stop edge 73 up to which the grommet part 67 may be received. Once received, the grommet part 67 is additionally sealing the interface between the grommet part 67 and the housing part 1 by abutment with the insertion stop edge 73. Cable channel portions 15*a* of the grommet part 67 form, together with cable channel portions 15*b* of the housing part 1, the cable channels 15. As noted before, FIG. 10 does not show a sealing gasket, therefore allowing to see the gasket notch 37.

As silicone material is less flexible than a gel 59 or a foam, the grommet part 67 comprises grommet extensions 71 providing extra material, which is adapted to fill any void when the housing assembly 45 is brought into the joined state 47. Those grommet extensions 71 and their essentially circular shape is best seen in the side profile of grommet part 67 shown in FIG. 11. Those edges may fill any free or void volume at the interface between separate sealing material (in the form of the grommet 67) and the cable 17.

FIG. 12 shows a cut side view of this embodiment of the inventive housing assembly 45 in the joined state 47, wherein the grommet 67 may be clearly seen in this figure. Is to be noted that also in this embodiment, also the previously described different embodiments of the sealing gasket may be applied.

Figure 13:
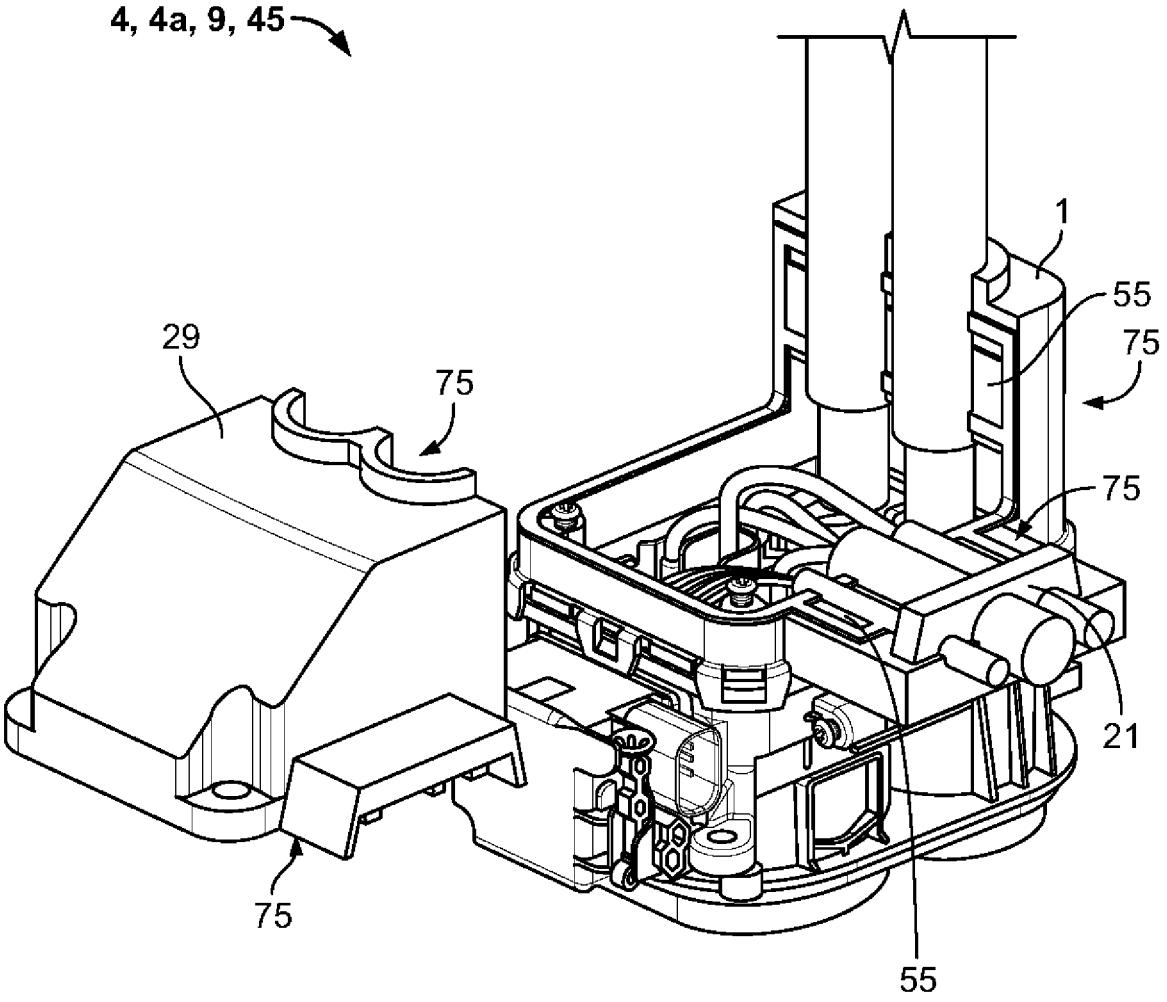
FIG. 13 is a perspective view of a housing assembly according to another embodiment in an angled configuration.

Finally, FIG. 13 shows another embodiment of the inventive housing assembly 45, which is shown in the unjoined state 9. This embodiment may be used in a 90° angled electrical connector 4*a*, which comprises a vertical flange portion and a horizontal flange portion. It is noted that the labeling vertical and horizontal does not limit those portions, as the actual orientation may change if the entire 90° angled electrical connector 4*a* is rotated.

The electric connector 4*a* comprises a housing part 1 and a complementary housing part 29, wherein both housing parts 1, 29 comprise two cable insertion portions 75, as shown in FIG. 13. The cable insertion portions 75 of a housing part 1, 29 are essentially oriented perpendicular to each other. Each cable insertion portion 75 comprises at least two cable sealing portions 27*a* and 27*b*, and in an embodiment also a separate sealing material 55 provided in between the cable sealing portions 27*a* and 27*b*. It is also conceivable that three or four or more of such cable insertion portions 75 may be provided that allow insertion of at least one cable from different directions.

In the embodiment shown in FIG. 13, only one strain relief member 21 is shown, wherein in a further possible embodiment of the inventive housing assembly 45, also the other cable insertion portion 75 of the housing part 1 may comprise such a strain relief member 21.

The previously described embodiments of the inventive complementary housing part 29 and their features may be transferred to each of the cable insertion portions 75 of the complementary housing part 29 shown in FIG. 13. In different embodiments of the housing assembly 45, more than two different cable insertion portions 75, e.g. with or without the separate sealing material 55 may be comprised.

What is claimed is:

1. A housing part for an electrical connector, comprising:
- a cable channel receiving a cable;
- a flange surface adapted to abut a complementary housing part;
- a sealing gasket extending along the flange surface, the sealing gasket has a first pair of cable sealing portions extending across the cable channel, the cable sealing portions are spaced apart from one another in an axial direction of the cable channel; and
- a second pair of cable sealing portions arranged at least partly in parallel with the first pair of cable sealing portions.

2. The housing part of claim 1, wherein the sealing gasket is embedded in the flange surface.

3. The housing part of claim 1, wherein the sealing gasket is embedded in a wall that at least partially surrounds the cable channel.

4. The housing part of claim 3, wherein the wall is formed by a pair of protruding ribs spaced apart from each other.

5. The housing part of claim 4, wherein the cable sealing portions are provided at the protruding ribs.

6. The housing part of claim 5, further comprising a supporting rib spaced apart in the axial direction from the protruding ribs.

7. The housing part of claim 6, wherein the supporting rib supports the cable received in the cable channel.

8. The housing part of claim 7, further comprising a strain relief member disposed between one of the protruding ribs and the supporting rib.

9. The housing part of claim 4, wherein each of the protruding ribs has a groove in which one of the cable sealing portions is received.

10. The housing part of claim 1, further comprising a separate sealing material arranged between the cable sealing portions.

11. The housing part of claim 1, wherein the sealing gasket has a double-rib sealing surface.

12. A housing assembly, comprising:
- a housing part including a cable channel receiving a cable, a flange surface, and a sealing gasket extending along the flange surface further comprising:
  - a first pair of cable sealing portions extending across the cable channel spaced apart from one another in an axial direction of the cable channel;
  - a second pair of cable sealing portions arranged at least partly in parallel with the first pair of cable sealing portions; and
- a complementary housing part adapted to be joined with the housing part at the flange surface.

13. The housing assembly of claim 12, wherein the sealing gasket of the housing part and a sealing gasket of the complementary housing part abut one another in a joined state of the housing part and the complementary housing part.

14. The housing assembly of claim 13, wherein a contour of the sealing gasket of the housing part and a contour of the sealing gasket of the complementary housing part are complementary in an unjoined state of the housing part and the complementary housing part.

15. The housing assembly of claim 12, further comprising a strain relief member disposed between one of a pair of protruding ribs forming a cable channel wall of the housing part and an outer wall of the housing assembly.

16. The housing assembly of claim 12, wherein the cable channel of the housing part and a cable channel of the complementary housing part form a cable opening in a joined state of the housing part and the complementary housing part.

17. The housing assembly of claim 16, wherein the cable channel of the housing part and/or the cable channel of the complementary housing part have a bulkhead protruding from a bottom of the cable channel.

* * * * *